US006353172B1

(12) United States Patent
Fay et al.

(10) Patent No.: US 6,353,172 B1
(45) Date of Patent: Mar. 5, 2002

(54) MUSIC EVENT TIMING AND DELIVERY IN A NON-REALTIME ENVIRONMENT

(75) Inventors: Todor C. Fay, Bellevue; James F. Geist, Jr., Kirkland, both of WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 09/243,073

(22) Filed: Feb. 2, 1999

(51) Int. Cl.[7] ..... A63H 5/00; G04B 13/00; G10H 7/00

(52) U.S. Cl. ..... 84/609; 84/645

(58) Field of Search ..... 84/609, 634, 637, 84/645

(56) References Cited

U.S. PATENT DOCUMENTS

| | | | | | |
|---|---|---|---|---|---|
| 4,526,078 | A | | 7/1985 | Chadabe | 84/1.03 |
| 4,716,804 | A | | 1/1988 | Chadabe | 84/1.03 |
| 5,052,267 | A | | 10/1991 | Ino | 84/613 |
| 5,164,531 | A | | 11/1992 | Imaizumi et al. | 84/634 |
| 5,179,241 | A | | 1/1993 | Okuda et al. | 84/613 |
| 5,218,153 | A | | 6/1993 | Minamitaka | 84/613 |
| 5,278,348 | A | | 1/1994 | Eitaki et al. | 84/636 |
| 5,281,754 | A | | 1/1994 | Farrett et al. | 84/609 |
| 5,286,908 | A | * | 2/1994 | Jungleib | 81/603 |
| 5,300,725 | A | * | 4/1994 | Manabe | 84/645 X |
| 5,315,057 | A | * | 5/1994 | Land et al. | 84/601 |
| 5,355,762 | A | | 10/1994 | Tabata | 84/609 |
| 5,455,378 | A | | 10/1995 | Paulson et al. | 84/610 |
| 5,496,962 | A | | 3/1996 | Meier et al. | 84/601 |
| 5,734,119 | A | * | 3/1998 | France et al. | 84/645 X |
| 5,753,843 | A | | 5/1998 | Fay | 84/609 |
| 5,811,706 | A | * | 9/1998 | Buskirk et al. | 84/645 X |
| 5,827,989 | A | * | 10/1998 | Fay et al. | 84/645 |
| 5,883,957 | A | * | 3/1999 | Moline et al. | |
| 5,902,947 | A | * | 5/1999 | Burton et al. | 84/645 X |

* cited by examiner

*Primary Examiner*—Jeffrey Donels
(74) *Attorney, Agent, or Firm*—Lee & Hayes, PLLC

(57) ABSTRACT

A music generation and playback system includes an application program and a music processing component. The application program makes repeated calls to the music processing component and provides a group of music events to be sent to the music processing component during each call. Each group of events comprises a plurality of individual events and associated timestamps indicating when the events are to be played. The timestamps of the individual music events of a particular group indicate that the events are to be played at varying times subsequent to being sent to the music processing component. The music processing component exposes a latency clock interface, which indicates the earliest time at which a new music event can be rendered. The application program uses this interface to determine how far ahead of time to provide new music events, and to schedule spontaneously occurring events for playback at the earliest possible time.

61 Claims, 6 Drawing Sheets

108 110

| Event Data | Time Stamp |
|---|---|
| Event Data | Time Stamp |
| Event Data | Time Stamp |
| Event Data | Time Stamp |
| Event Data | Time Stamp |
| Event Data | Time Stamp |

MUSIC EVENT TIMING AND DELIVERY IN A NON-REALTIME ENVIRONMENT

TECHNICAL FIELD

This invention relates to methods of sequencing music events and passing them to hardware drivers and associated devices for playing.

BACKGROUND OF THE INVENTION

Context-sensitive musical performances have become essential components of electronic and multimedia products such as stand-alone video games, computer based video games, computer based slide show presentations, computer animation, and other similar products and applications. As a result, music generating devices and/or music playback devices have become tightly integrated with electronic and multimedia products.

Previously, musical accompaniment for multimedia products was provided in the form of pre-recorded music that could be retrieved and performed under various circumstances. One disadvantage of this technique was that the pre-recorded music required a substantial amount of memory storage. Another disadvantage was that the variety of music that could be provided was limited by the amount of available memory.

Today, music generating devices are directly integrated into electronic and multimedia products for composing and providing context-sensitive musical performances. These musical performances can be dynamically generated and varied in response to various input parameters, real-time events, and conditions. For instance, in a graphically based adventure game the background music can change from a happy, upbeat sound to a dark, eerie sound in response to a user entering into a cave or some other mystical area. Thus, a user can experience the sensation of live musical accompaniment as he engages in a multimedia experience.

In a typical prior art music generation architecture, an application program communicates with a synthesizer or synthesizer driver using some type of dedicated communication interface, commonly referred to as an "application programming interface" (API). In a system such as this, the application program delivers notes or other music events to the synthesizer, and the synthesizer plays the notes immediately upon receiving them. The notes and music events are represented as data structures containing information about the notes and other events, such as pitch, relative volume, duration, etc.

In the past, synthesizers have been implemented in hardware as part of a computer's internal sound card or as an external device such as a MIDI (musical instrument digital interface) keyboard or module. With the availability of more powerful computer processors, however, synthesizers are now being implemented in computer software.

Whether the synthesizer is implemented in hardware or software, the delivery of music events needs to be precisely timed—each event needs to be delivered to the synthesizer at the precise time at which the event is to be played.

Achieving such precise delivery timing can be a problem when running under multitasking operating systems such as the Microsoft Windows operating system. In systems such as this, which switch between multiple concurrently-running application programs, it is often difficult to guarantee that an application program will be "active" at any particular time.

Various mechanisms, such as interrupt-based callbacks from the operating system, can be used to simulate real-time behavior and to thus ensure that events are delivered by application programs on time. However, this type of operation is awkward and is not supported in all environments. Other systems have utilized different forms of time-stamping, in which music events are delivered ahead of time along with associated indications (timestamps) of when the events are to happen. As implemented in the past, however, time-stamping has been somewhat restrictive. One problem with prior art time-stamping schemes is that not all synthesizers or other receiving devices have dealt with timestamps in the same way. In addition, the identification of a reference clock has been problematic.

Software-based synthesizers introduce further complications related to delivery timing. Specifically, a software-based synthesizer is more likely to exhibit a noticeable latency between the time it receives an event and the time the event is actually produced or heard. In contrast to the operation of a hardware synthesizer, which processes its various voices on a sample-by-sample basis, a software synthesizer typically produces wave data for discrete periods of time that can range from 10 milliseconds to over 50 milliseconds. Once the synthesizer begins processing the wave data for an upcoming period, new events can begin only after this period. Accordingly, such a software synthesizer exhibits a variable latency, depending on whether the synthesizer is in the process of calculating wave data for one of the periods. Event delivery can become especially troublesome when delivering notes concurrently to different synthesizers, each of which might have a different (and constantly varying) latency.

Yet another problem with the prior art arises because hardware drivers and software-based synthesizers are typically implemented in the kernel portion of a computer's operating system. Because of this, calling the synthesizer or hardware driver requires a ring transition (a transition from the application address space to the operating system address space) for each event delivered to the hardware driver or synthesizer. Ring transitions such as this are very expensive in terms of processor resources.

Thus, there is a need for an improvement in the way music events are delivered from application programs to music rendering devices such as synthesizers. Such a delivery system should work with synthesizers and other hardware drivers that have different latencies, including synthesizers and hardware drivers having variable latencies. It should also ease the burden of real-time event delivery, and reduce the overhead of application-to-kernel ring transitions.

SUMMARY OF THE INVENTION

In accordance with the invention, a master clock is maintained for use by application programs and by music processing components. Applications then time-stamp music events before sending the music events to music processing components. The music processing components then take responsibility for playing the events at the proper times, with reference to the master clock. Music processing components are designed to expose a latency clock interface. At any moment, the latency clock interface indicates the earliest time, in the same time base as used by the master clock, at which a new event can be rendered. This interface gives application programs the information they need to provide music events far enough in advance to overcome variable latencies of the music processing components.

Rather than sending events one at a time to the music processing components, an application program periodically compiles groups or buffers containing time-stamped events that arc to be played in the immediate future. These groups are provided to kernel-mode music processing components, so that a plurality of music events can be provided to kernel-mode components using only a single ring transition.

DETAILED DESCRIPTION

Computing Environment

Figure 1:
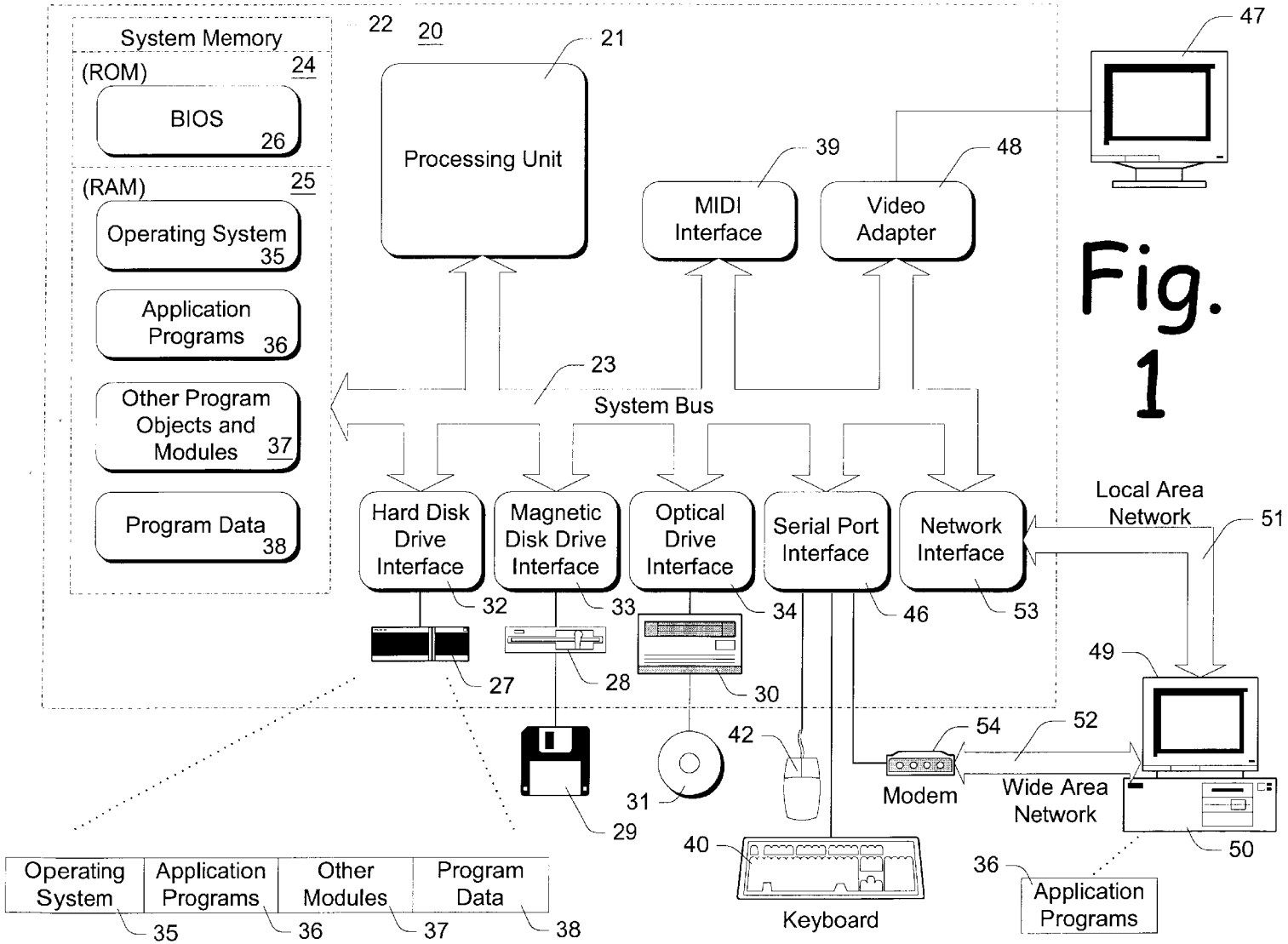
FIG. 1 is a block diagram of a computing environment in which the invention is implemented.

FIG. 1 and the related discussion give a brief, general description of a suitable computing environment in which the invention may be implemented. Although not required, the invention will be described in the general context of computer-executable instructions, such as programs and program modules that are executed by a personal computer. Generally, program modules include routines, programs, objects, components, data structures, etc. that perform particular tasks or implement particular abstract data types. Moreover, those skilled in the art will appreciate that the invention may be practiced with other computer system configurations, including hand-held devices, multiprocessor systems, microprocessor-based or programmable consumer electronics, network PCs, minicomputers, mainframe computers, and the like. The invention may also be practiced in distributed computer environments where tasks are performed by remote processing devices that are linked through a communications network. In a distributed computer environment, program modules may be located in both local and remote memory storage devices.

An exemplary system for implementing the invention includes a general purpose computing device in the form of a conventional personal computer 20, including a microprocessor or other processing unit 21, a system memory 22, and a system bus 23 that couples various system components including the system memory to the processing unit 21. The system bus 23 may be any of several types of bus structures including a memory bus or memory controller, a peripheral bus, and a local bus using any of a variety of bus architectures. The system memory includes read only memory (ROM) 24 and random access memory (RAM) 25. A basic input/output system 26 (BIOS), containing the basic routines that help to transfer information between elements within personal computer 20, such as during start-up, is stored in ROM 24. The personal computer 20 further includes a hard disk drive 27 for reading from and writing to a hard disk, not shown, a magnetic disk drive 28 for reading from or writing to a removable magnetic disk 29, and an optical disk drive 30 for reading from or writing to a removable optical disk 31 such as a CD ROM or other optical media. The hard disk drive 27, magnetic disk drive 28, and optical disk drive 30 are connected to the system bus 23 by a hard disk drive interface 32, a magnetic disk drive interface 33, and an optical drive interface 34, respectively. The drives and their associated computer-readable media provide nonvolatile storage of computer readable instructions, data structures, program modules and other data for the personal computer 20. Although the exemplary environment described herein employs a hard disk, a removable magnetic disk 29 and a removable optical disk 31, it should be appreciated by those skilled in the art that other types of computer readable media which can store data that is accessible by a computer, such as magnetic cassettes, flash memory cards, digital video disks, Bernoulli cartridges, random access memories (RAMs) read only memories (ROM), and the like, may also be used in the exemplary operating environment.

RAM 25 forms executable memory, which is defined herein as physical, directly-addressable memory that a microprocessor accesses at sequential addresses to retrieve and execute instructions. This memory can also be used for storing data as programs execute.

A number of programs and/or program modules may be stored on the hard disk, magnetic disk 29 optical disk 31, ROM 24, or RAM 25, including an operating system 35, one or more application programs 36, other program objects and modules 37, and program data 38. A user may enter commands and information into the personal computer 20 through input devices such as keyboard 40 and pointing device 42. Other input devices (not shown) may include a microphone, joystick, game pad, satellite dish, scanner, or the like. These and other input devices are often connected to the processing unit 21 through a serial port interface 46 that is coupled to the system bus, but may be connected by other interfaces, such as a parallel port, game port, or a universal serial bus (USB). A monitor 47 or other type of display device is also connected to the system bus 23 via an interface, such as a video adapter 48. In addition to the monitor, personal computers typically include other peripheral output devices (not shown) such as speakers and printers.

Computer 20 includes a musical instrument digital interface ("MIDI") component 39 that provides a means for the computer to generate music in response to MIDI-formatted data. In many computers, such a MIDI component is implemented in a "sound card," which is an electronic circuit installed as an expansion board in the computer. The MIDI component responds to MIDI events by playing appropriate tones through the speakers of the computer.

The personal computer 20 may operate in a networked environment using logical connections to one or more remote computers, such as a remote computer 49. The remote computer 49 may be another personal computer, a server, a router, a network PC, a peer device or other common network node, and typically includes many or all of the elements described above relative to the personal computer 20, although only a memory storage device 50 has been illustrated in FIG. 1. The logical connections depicted in FIG. 1 include a local area network (LAN) 51 and a wide area network (WAN) 52. Such networking environments are commonplace in offices, enterprise-wide computer networks, intranets, and the Internet.

When used in a LAN networking environment, the personal computer 20 is connected to the local network 51 through a network interface or adapter 53. When used in a WAN networking environment, the personal computer 20 typically includes a modem 54 or other means for establishing communications over the wide area network 52, such as the Internet. The modem 54, which may be internal or external, is connected to the system bus 23 via the serial port interface 46. In a networked environment, program modules depicted relative to the personal computer 20, or portions thereof, may be stored in the remote memory storage device. It will be appreciated that the network connections shown are exemplary and other means of establishing a communications link between the computers may be used.

Generally, the data processors of computer 20 are programmed by means of instructions stored at different times in the various computer-readable storage media of the computer. Programs and operating systems are typically distributed, for example, on floppy disks or CD-ROMs. From there, they are installed or loaded into the secondary memory of a computer. At execution, they are loaded at least partially into the computer's primary electronic memory. The invention described herein includes these and other various types of computer-readable storage media when such media contain instructions or programs for implementing the steps described below in conjunction with a microprocessor or other data processor. The invention also includes the computer itself when programmed according to the methods and techniques described below. Furthermore, certain sub-components of the computer may be programmed to perform the functions and steps described below. The invention includes such sub-components when they are programmed as described.

For purposes of illustration, programs and other executable program components such as the operating system are illustrated herein as discrete blocks, although it is recognized that such programs and components reside at various times in different storage components of the computer, and are executed by the data processor(s) of the computer.

The illustrated computer uses an operating system such as the "Windows" family of operating systems available from Microsoft Corporation. An operating system of this type can be configured to run on computers having various different hardware configurations, by providing appropriate software drivers for different hardware components. The functionality described below is implemented using standard programming techniques, including the use of OLE (object linking and embedding) and COM (component object interface) interfaces such as described in Rogerson, Dale; *Inside* COM, Microsoft Press, 1997. Familiarity with object-based programming, and with COM objects in particular, is assumed throughout this disclosure.

Event Timestamps

Figures 2, 3:
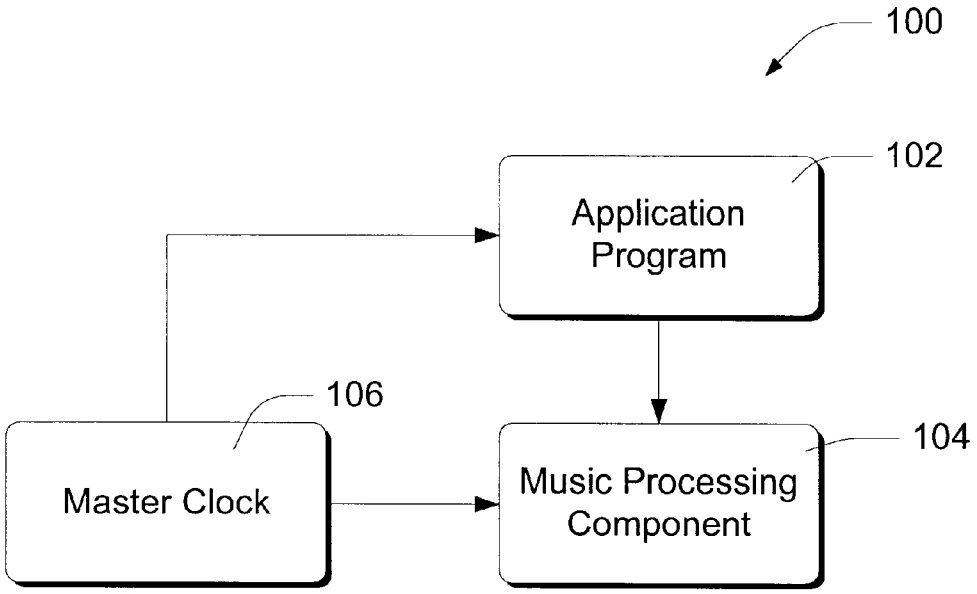
FIG. 2 is a block diagram of a first embodiment of the invention.
FIG. 3 is a block diagram showing a plurality of music events and associated timestamps.

FIG. 2 shows a music generation system 100 in accordance with the invention, which is implemented within the computer illustrated in FIG. 1. Music generation system 100 includes an application program 102 and a music processing component 104. The application program is one of a variety of different types of programs, such as a game program, some other type of entertainment program, or any other program that generates music events that are to be played by a separate music processing component of a computer. In the described embodiment, the application program generates MIDI events such as "note-on", "note-off" and other events. Each event is represented by a data structure that specifies the event in terms of different values, depending on the nature of the event.

The application program also time-stamps each music event. The timestamp for a music event indicates the time at which the event is to be played. The timestamp is specified relative to a master clock 106, or some other agreed-upon time reference that is used in common by music processing component 104 and any other music processing components to which time-stamped music events are sent. The master clock is preferably based on some hardware source such as a CPU crystal, a computer's internal time-of-day clock circuitry, or a soundcard sample rate crystal. The time source represents a forward moving reference time that the application program and all music processing devices can use as a time reference. It has a resolution of one millisecond or less.

FIG. 3 shows a sequence of music events 108, each of which is associated with its own timestamp 110. The application sends each music event and its associated timestamp to music processing component 104 prior to the time at which the music event is to be played. Specifically, the application program sends a particular music event to music processing component 104 at a time that is early enough to allow the music processing component to process and play the event at the time indicated by the event's timestamp. Upon receiving a music event, the music processing component processes the event and plays it at the specified time, regardless of the time at which the event was sent by the application program and received by the music processing component. The music processing component references master clock 106 to interpret the timestamp of the event, and to thereby determine the proper time at which to play the event. In accordance with the invention, the music events do not need to be arranged temporally.

In one embodiment of the invention, music processing component 104 is a synthesizer that receives the time-stamped events and processes them to be played at the times indicated by their timestamps. Because the synthesizer uses the same master clock 106 as was used to calculate the timestamps, very accurate timing can be achieved. This embodiment is particularly desirable for use with a software-based synthesizer, which can execute in either user mode or kernel mode. The use of timestamps allows events to be delivered well ahead of time, far enough ahead of the synthesizer to avoid any problems that might otherwise result from variable latency.

Figure 4:
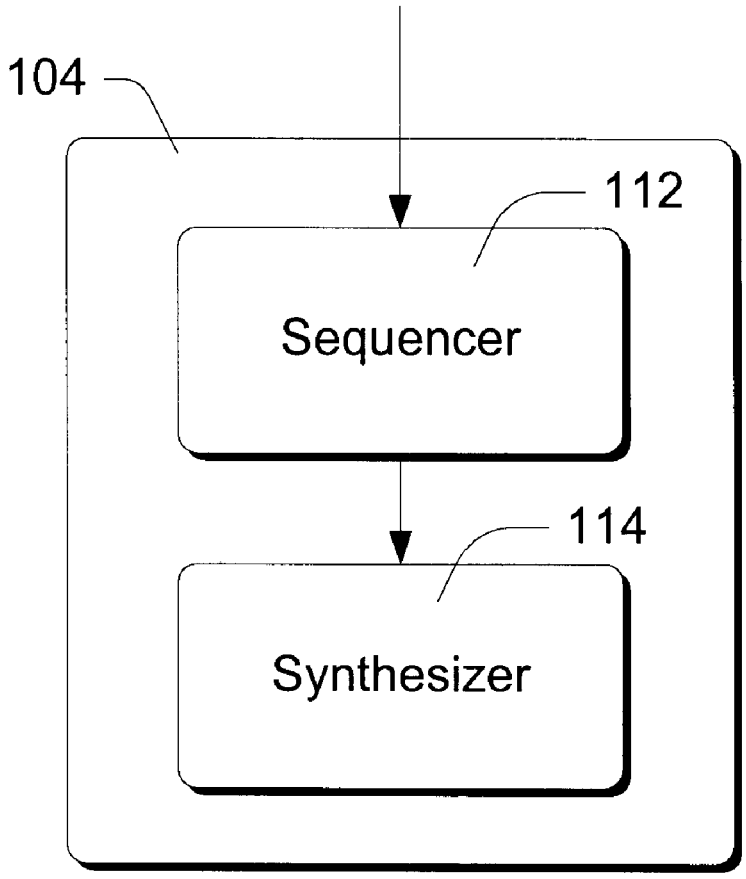
FIG. 4 is a block diagram of a music processing component in accordance with the invention.

FIG. 4 shows another embodiment of a music processing component 104 in accordance with the invention. It includes a sequencer 112 and a synthesizer 114. This embodiment is appropriate for use with a hardware synthesizer having negligible latency, which expects to receive events at the times the events are to happen. However, synthesizer 114 could be a software-based synthesizer.

Sequencer 112 receives music events from application program 102 of FIG. 2, examines the associated timestamps, and delivers the events themselves to synthesizer 114 at the precise times indicated by the timestamps. In this described embodiment, the synthesizer is configured to receive MIDI-formatted events and to process them in accordance with MIDI standards. In many cases, block 114, representing the synthesizer, is actually a synthesizer driver that interacts with synthesizer hardware.

One advantage of a system utilizing components such as those shown in FIGS. 3 and 4 is that different types of components can be utilized in a single system and can be treated the same by the application program. Specifically, events are time-stamped in exactly the same way whether they are destined for a software-based synthesizer or a hardware-based synthesizer, and whether the synthesizers are kernel-mode components or user-mode components.

Each music processing component is designed to play music events at the stamped times, with reference to the same master clock.

Event Buffering

Figure 5:
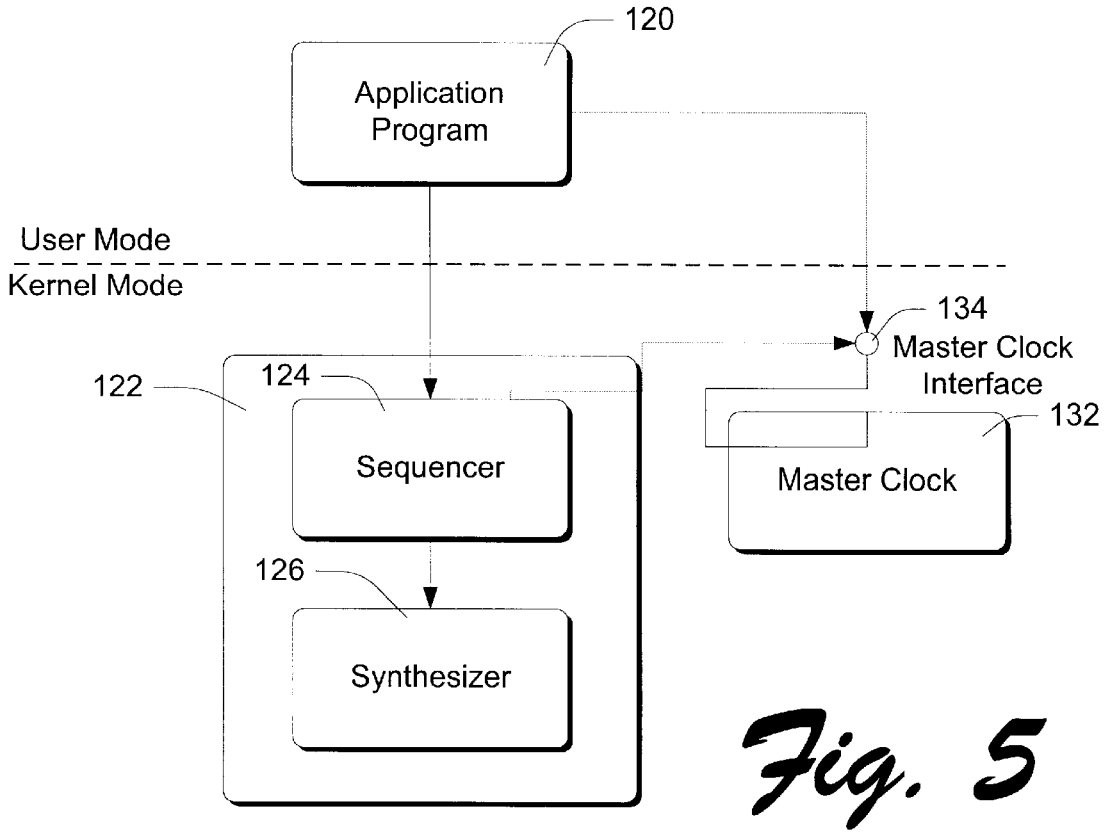
FIG. 5 is a block diagram of a second embodiment of the invention.

FIG. 5 shows another embodiment of the invention. This embodiment includes a user-mode or non-kernel-mode application program 120 and a kernel-mode music processing component 122. The kernel-mode music processing component 122 comprises a sequencer 124 and synthesizer 126, generally as described above.

Modern operating systems typically provide both user and kernel modes of operation. Kernel mode is usually associated with and reserved for portions of the operating system. Kernel-mode components run in a reserved address space, which is protected from user-mode components. User-mode components have their own respective address spaces, and can make calls to kernel-mode components using special procedures that require so-called "ring transitions" from one privilege level to another. A ring transition involves a change in execution context, which involves not only a change in address spaces, but also a transition to a new processor state (including register values, stacks, privilege mode, etc). As already discussed, such ring transitions are expensive, and are avoided whenever possible.

In the system of FIG. 5, the user-mode application program needs to pass music events to the kernel-mode music processing component 122. However, each call to the kernel-mode music processing component involves an expensive ring transition.

In order to reduce the required number of ring transitions, application program 120 first time-stamps a plurality of music events and sends them as a group to music processing component 122. Generally, the timestamps of the individual music events of a group indicate that the music events are to be played at varying times subsequent to being sent to the music processing component. The application program sends each compiled group of time-stamped music events as an integral group or data structure, in a single call and using a single ring transition, to music processing component 122. The application program does this repeatedly-it makes repeated calls to the kernel-mode music processing component and provides a group of time-stamped music events to the music processing component during each call.

Upon receiving a group of events, the music processing component examines their timestamps and plays the individual events at the times indicated by the respective timestamps.

Figure 6:
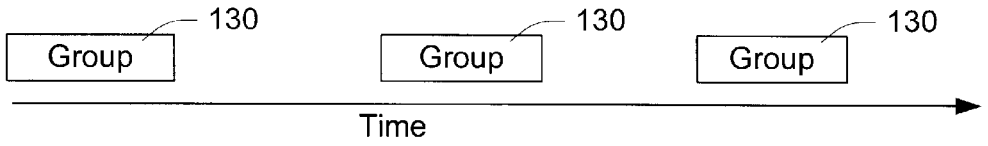
FIG. 6 is a diagram showing a time sequence of music event groups.

FIG. 6 illustrates successive groups 130 of music notes that are sent over time to music processing component 122. Each group includes a plurality of music events and associated timestamps, such as shown previously in FIG. 3. The groups are potentially variable in size (number of music events). They are sent at variable intervals, so that events are provided to the synthesizer by the time at which the events are to occur. Each group potentially contains out-of-sequence events. That is, the events within a group are not necessarily arranged in time order. Furthermore, the groups themselves can be out of time order and can overlap each other in time.

All timestamps are relative to a common master clock 132. This master clock has an interface 134 that is accessible to application programs and to kernel-mode components such as sequencer 124. The kernel-mode music processing component references master clock 132 to determine when to play individual events. In the embodiment described, sequencer 124 arranges and queues the notes in the order in which they are to be played, and provides them to synthesizer 126 at the times they are to be played. If synthesizer 126 has a known latency, the notes are provided early to account for the latency. Preferably, synthesizer 126 is designed so that its latency can be queried by sequencer 124.

In actual implementation, each group of music events includes a start time that is specified relative to the master clock. Each timestamp within the group is then specified relative to the start time. This allows a group to be easily shifted in time, by simply changing the start time.

Figure 7:
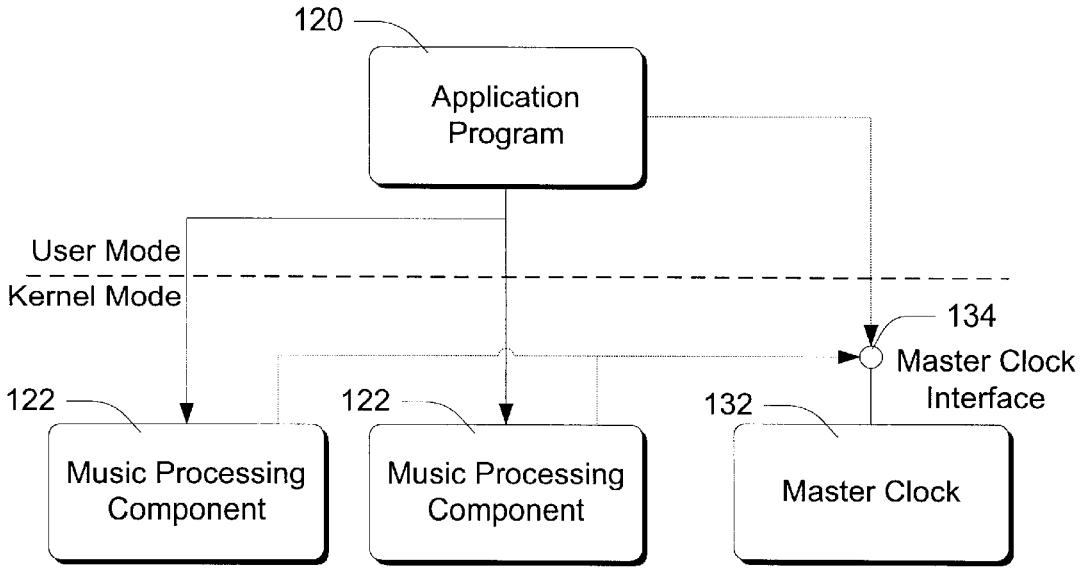
FIG. 7 is a block diagram of a third embodiment in accordance with the invention.

FIG. 7 shows an embodiment of the invention that includes a plurality of music processing components 122. The application program 120 sends groups of time-stamped music events to each of these components, in the manner described above. All the music processing component reference the same master clock 132 through its interface 134.

Master clock 132 can be based on a number of different sources as already noted, such as a computer system clock or other hardware clock maintained on an individual sound card or synthesizer. Once a master clock is selected, however, the same clock is used for all music data timing.

Although the examples of FIGS. 6 and 7 show kernel-mode music processing components, the described method of grouping time-stamped events before sending them to a music processing components has advantages that are also applicable to situations where one or more of the music processing components are implemented in user mode. Specifically, this method of passing music events to music processing components reduces the extent to which application programs are required to exhibit real-time behavior. Instead, an application program can buffer groups of notes ahead of the times at which they are to be played. The receiving music processing component queues the events and thereby assumes responsibility for playing the events according to their timestamps. Yet a further advantage is that the application program does not need to be concerned with differing and variable latencies exhibited by the various music processing components. Rather, the components themselves can account for latencies in ways that are particular to such components. Further considerations regarding synthesizer latencies are discussed in the following section.

Another significant advantage of this method, when music processing components are kernel-mode components, is that the number of ring transitions from user mode to kernel mode is greatly reduced by passing groups of events in single ring transitions.

Latency Considerations

Figure 8:
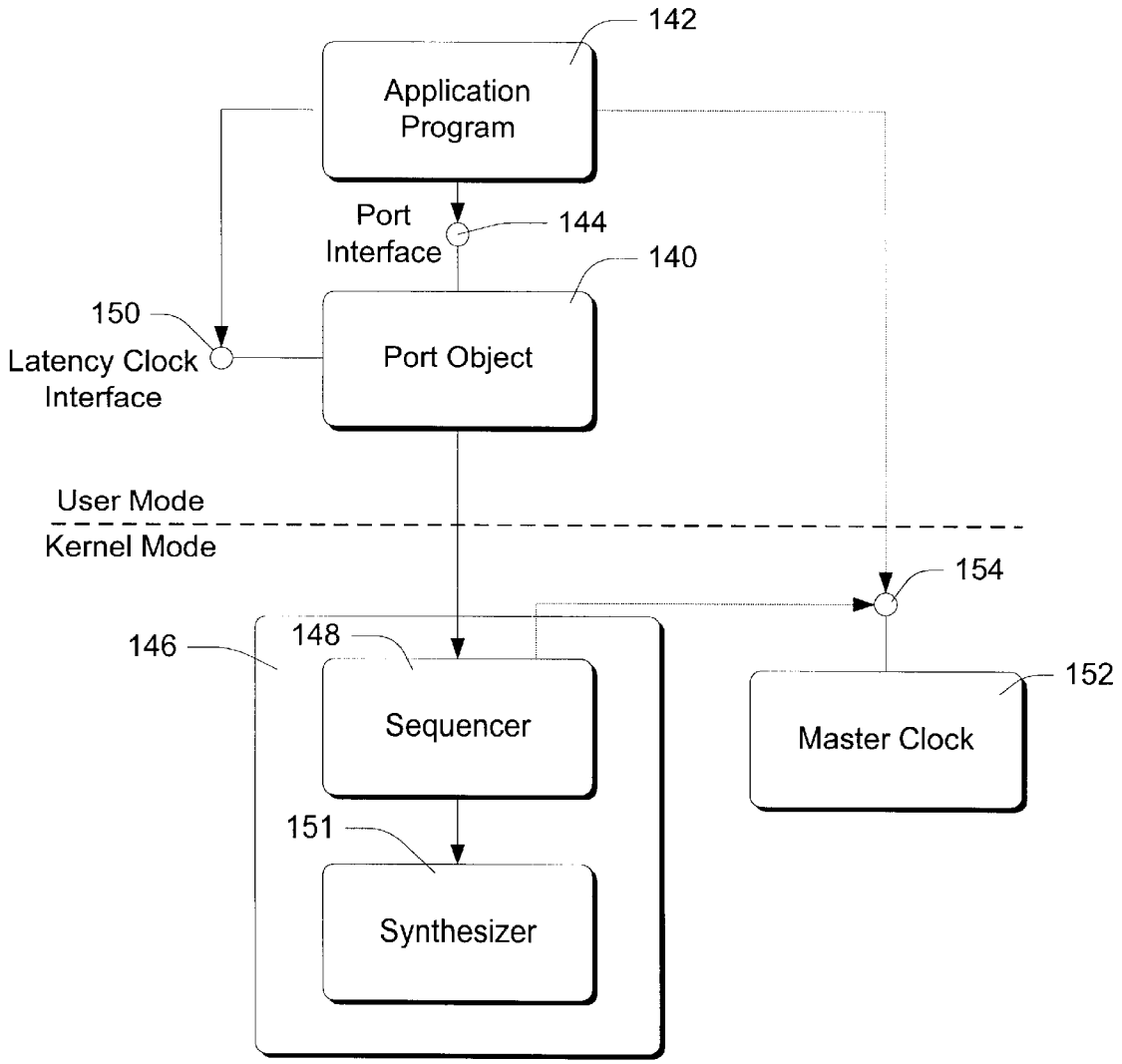
FIG. 8 is a block diagram of a fourth embodiment in accordance with the invention.

FIG. 8 shows an embodiment of the invention that provides an efficient method of accounting for synthesizer latencies. As already discussed above, software-based synthesizers often exhibit significant latency. This creates problems for an application program, especially when the application program is attempting to deal with real-time events such as events that are driven or initiated by user actions. The problem is exacerbated when such latencies vary with time.

FIG. 8 is similar to FIG. 5, with the introduction of a port object 140. The port object is a COM object that is associated with and represents a particular synthesizer or other music processing device. It is instantiated by an application program 142 in the application program's own address space, and therefore runs in user mode. The port object has a port interface 144 that accepts groups of time-stamped music events as already described above. The port object handles communications with the associated processing component 146. In this embodiment, processing component 146 is a kernel-mode component, although it could alternatively be a user-mode component. After receiving a group of music events, port interface 144 initiates calls to music processing component 146 to deliver the group of music events to the music processing component.

Port object 140 also exposes a latency clock interface 150. This interface is callable to return the earliest time at which the underlying synthesizer or synthesizer driver can play a new note. The application program calls the latency clock interface to determine the latency of the synthesizer, in order to provide events early enough to be played by the synthesizer at the desired times. The time returned by the latency clock interface is specified relative to a master clock 152, which is the same master clock used by all music-related components of the system. Specifically, the latency clock interface returns the earliest absolute time at which a new event can be rendered or played, using the same time base as master clock 152. When sending groups of events, the application program 142 sends them far enough ahead of time to ensure that they can be played at the desired times, in light of the latency indicated by the latency clock. More specifically, an application typically uses the latency clock in two ways:

1) When staring a new sequence of notes or other events, the application program queries the latency clock to find the earliest time it can start playback. It uses this time to timestamp the starting of the sequence. The sequence can they play smoothly from that point on, rather than several or all of the initial notes colliding at the end of the latency period.
2) Once the sequence is playing, the application adds a reasonably safe offset to the initially-determined latency, and consistently queues the sequence notes while accounting for this conservative estimate of latency.

The latency of a port depends on many factors, including hardware latencies and latencies exhibited by software synthesizers as they produce wave data from submitted events. For example, if a software synthesizer has just begun processing the waveform data for a 10 millisecond period, it might be close to 10 milliseconds before a new event can be rendered. If, however, the software synthesizer is done or nearly done processing a 10 millisecond period of waveform data, the current latency might be close to zero. Because latency is so dependent on the underlying software and hardware components, the port object will often pass responsibility for the latency clock to the underlying music processing component.

Interaction between the sequencer 148 and the synthesizer or synthesizer driver 151 varies depending on the characteristics and needs of the synthesizer. For low-latency synthesizers that expect events at the instant playback is desired, the sequencer queues events as they are received and sends them to the synthesizer at the times indicated by their timestamps. For software-based synthesizers and other components that exhibit more noticeable latencies, events need to be delivered to the synthesizer or synthesizer driver ahead of the times at which the events are to be played. In this case, the sequencer queries the synthesizer or driver to determine how far ahead of time the events should be delivered. The sequencer queues events and delivers any events that are within the specified latency of the synthesizer or driver.

Methodological Aspects

Although the invention has been described above primarily in terms of its components and their characteristics, the invention also includes methodological steps performed by a computer or similar device to implement the features described above.

Methodological steps in accordance with the invention include calling a music processing component to determine the earliest time at which the music processing component can play new music events. A further step comprises compiling a group of music events that are to be played after the earliest time indicated by the music processing components.

Further steps in accordance with the invention comprise time-stamping the music events of the compiled group with varying times at which the respective events are to be played, and sending the music events and their associated timestamps as a group to the music processing component, in a single program call, prior to any of the times indicated by the timestamps. Theses steps arc performed repeatedly to provide groups of music events and their timestamps to the music processing component early enough to be played at the times indicated by the corresponding timestamps.

In one embodiment, the music processing component contains a sequencer that receives the groups of music events that then performs a step of providing the events of the group to a synthesizer or synthesizer driver at the times indicated by the timestamps of the individual events. The synthesizer or driver plays the individual events as they are received.

Conclusion

The invention provides a number of significant advantages over the prior art. Many of these advantages result from the common use of a universal time source that is tied to a hardware device. An application program can timestamp all events with reference to this universal time source, and can then be assured that the events will be played in synchronization regardless of the music processing component to which the events are eventually destined. This also allows events and groups of events to be sent out of order. It also allows one process to stream predefined events to a synthesizer, while another process spontaneously sends events to the synthesizer in response to user input.

The use of a common time source also allows the system to efficiently handle incoming events—events generated externally to the application program. These events are time-stamped by device drivers with reference to the universal time source. This allows the application program to determine the relative order in which the events were generated, regardless of the times at which the events were actually received by the application program.

Using a common time source also allows an application program to understand the relation in time of incoming events to events that are currently playing. This allows an application program to perform a task such as recording incoming notes, and time-stamping them very accurately in relation to concurrently playing notes.

The system allows spontaneous sequences to play as soon as possible. More conventional designs might have simply chosen a "worst-case" latency and assumed that same latency for all events. The system described above, however, provides a variable latency clock that allows events to be time-stamped with the earliest possible time at which they can be rendered, based on the current latency of the synthesizer.

This system also allows spontaneous sequences to be played quickly, while preserving the relative timing of events within the sequences.

Another advantage of the system described above is that it significantly reduces the number of user-mode to kernel-mode ring transitions, by grouping events and sending entire groups in single calls to kernel-mode components.

Further advantages are obtained by providing sequencing functions in conjunction with synthesizers, thereby relieving the application program of any real-time sequencing responsibilities. Instead, the application consults a latency clock and a master clock to pace the rate of playback and to stay a safe margin ahead of the synthesizer.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. A method of sending music events from an application program to one or more music processing components, comprising:

time-stamping a plurality of music events with varying times at which the respective events are to be played, wherein the timestamp reflects any processing latency of the processing component to ensure rendering at each of the varying times, and sending the plurality of music events and their timestamps as a group to one or more music processing components prior to any of said times at which the events are to be played.

2. A method as recited in claim 1, wherein the one or more music processing components comprise a plurality of music processing components, wherein all of the music processing components use a common time base to interpret the timestamps of the music events.

3. A method as recited in claim 1, wherein the one or more music processing components comprise a kernel-mode driver.

4. A method as recited in claim 1, wherein the one or more music processing components comprise a sequencer that performs steps comprising:

receiving the group of music events;

providing the individual music events of the group to a synthesizer driver at the times indicated by the timestamps of the individual music events.

5. A method as recited in claim 1, wherein the one or more music processing components comprise a software-based synthesizer.

6. A method as recited in claim 1, wherein the one or more music processing components comprise a hardware-based synthesizer.

7. A method as recited in claim 1, wherein the one or more music processing components comprise a synthesizer driver.

8. A method as recited in claim 1, wherein the music events comprise data structures specifying music notes.

9. A method as recited in claim 1, wherein the music events are out of time order within the group.

10. A computer, comprising:

an application program;

a music processing component;

wherein the application program initiates repeated calls to the music processing component and provides a group of music events to be sent to the music processing component during each call;

wherein said group of music events comprises a plurality of individual music events and associated timestamps indicating when the music events are to be played, wherein the timestamps of the individual music events of a particular group indicate that the individual music events are to be played at varying times subsequent to being sent to the music processing component.

11. A computer as recited in claim 10, further comprising a plurality of music processing components, wherein all of the music processing components use a common time base to interpret the timestamps of the music events.

12. A computer as recited in claim 10, wherein the music processing component comprises a software-based synthesizer.

13. A computer as recited in claim 10, wherein the music processing component comprises a hardware-based synthesizer.

14. A computer as recited in claim 10, wherein the music processing component comprises a kernel-mode synthesizer.

15. A computer as recited in claim 10, wherein the music processing component comprises a user-mode synthesizer.

16. A computer as recited in claim 10, wherein the music processing component comprises:

a synthesizer driver;

a sequencer that receives the groups of music events and that provides the individual music events to the synthesizer driver at the times indicated by the timestamps of the individual music events.

17. A computer as recited in claim 10, wherein the music processing component comprises:

a synthesizer;

a sequencer that receives the groups of music events and that provides the individual music events to the synthesizer at the times indicated by the timestamps of the individual music events;

wherein the synthesizer plays the music events as they are received.

18. A computer as recited in claim 10, further comprising a non-kernel-mode port object associated with the music processing component, wherein the port object has an interface that is callable by the application program to initiate the calls to the music processing component.

19. A computer, comprising:

an application program;

a music processing component;

wherein the application program initiates repeated calls to the music processing component and provides a group of music events to be sent to the music processing component during each call;

wherein said group of music events comprises a plurality of individual music events and associated timestamps indicating when the music events are to be played, wherein the timestamps of the individual music events of a particular group indicate that the individual music events are to be played at varying times subsequent to being sent to the music processing component a port object associated with the music processing component, wherein the port object has an interface that is called by the application program to initiate the calls to the music processing component.

20. A computer as recited in claim 19, further comprising a plurality of music processing components, wherein all of the music processing components use a common time base to interpret the timestamps of the music events.

21. A computer as recited in claim 19, wherein the music processing component further comprises:

a synthesizer driver;

a sequencer that receives the groups of music events and that provides the individual music events to the synthesizer driver at the times indicated by the timestamps of the individual music events;

wherein the synthesizer driver plays the music events as they are received.

22. A computer program stored on one or more computer-readable storage media for receiving music events from an application program, which, when executed by a host computing system, implements a method comprising:

receiving groups of music events from the application program;

wherein each group of music events comprises a plurality of individual music events and associated timestamps indicating when the music events are to be played, wherein the timestamps of the individual music events of a particular group indicate that the individual music events are to be played at varying times subsequent to being received and reflect any inherent processing latency in rendering the music events by a synthesizer; and providing the individual music events of the groups to the synthesizer in accordance with the timestamps of the individual music events.

23. A computer program as recited in claim 22, wherein the providing step comprises providing the individual music events of the groups at the times indicated by the timestamps of the individual music events.

24. A computer program as recited in claim 22, wherein the providing step comprises providing the group of music events to a port object associated with a music processing component, wherein the port object performs a step of calling the music processing component to deliver the group of music events to the music processing component.

25. A computer program as recited in claim 22, wherein the providing step comprises providing the group of music events to a port object associated with a kernel-mode music processing component, wherein the port object performs a step of calling the kernel-mode music processing component to deliver the group of music events to the kernel-mode music processing component.

26. A method for sending music events from an application program to one or more music processing components, the method comprising:

time-stamping music events with times at which the events are to be played, wherein the timestamp reflects an inherent processing latency of each of the one or more music processing components; and sending the music events and their timestamps to a plurality of music processing components prior to the times at which the events are to be played;

playing the music events at the times indicated by their respective timestamps, regardless of the times at which the music events were sent;

wherein the plurality of music processing components all use a common time base to interpret the timestamps of the music events.

27. A method as recited in claim 26, wherein the sending step comprises sending the plurality of music events and their timestamps as a group to the one or more music processing components prior to any of the times indicated by the timestamps.

28. A method as recited in claim 26, wherein the sending step comprises sending the plurality of music events and their timestamps as a group to the one or more music processing components prior to any of the times indicated by the timestamps, the music processing components comprising a kernel-mode sequencer that performs steps comprising:

receiving groups of time-stamped music events;

providing the individual music events of the group to a synthesizer driver at the times indicated by the timestamps of the individual music events.

29. A method as recited in claim 26, wherein the at least one of the plurality of music processing components comprises a synthesizer.

30. A method as recited in claim 26, wherein music events comprise data structures specifying music notes.

31. A computer, comprising:

an application program;

a plurality of music processing components;

wherein the application program is programmed to time-stamp music events with times at which the events are to be played and to send the music events to the music processing components prior to the times at which they are to be played;

wherein the music processing components play the music events at the times indicated by their respective timestamps, regardless of the times at which the music events were sent;

wherein all of the music processing components use a common time base to interpret the timestamps of the music events.

32. A computer as recited in claim 31, wherein the application program sends a plurality of music events and their timestamps as a group to the music processing components prior to any of the times indicated by the timestamps.

33. A computer as recited in claim 31, wherein the application program sends a plurality of music events and their timestamps as a group to one of the music processing components prior to any of the times indicated by the timestamps, the music processing component comprising a kernel-mode sequencer that performs steps comprising:

receiving groups of time-stamped music events;

providing the individual music events of the group to a synthesizer driver at the times indicated by the timestamps of the individual music events.

34. A computer as recited in claim 31, wherein at least one of the music processing components comprises a synthesizer.

35. A computer as recited in claim 31, wherein music events comprise data structures specifying music notes.

36. A music generation system comprising:

an application program including music events, which are timestamped and sent to a music processing component for rendering; and a music processing component having a latency between the time at which it receives a music event and the earliest time at which it can play the music event, wherein the music processing component being callable by the application program to return the earliest time at which the music processing component can play a new music event.

37. A music generation system as recited in claim 36, wherein the latency is variable with time.

38. A music generation system as recited in claim 36, wherein the music processing component is callable to receive music events and associated timestamps, the timestamps indicating varying times at which the respective music events are to be played.

39. A music generation system as recited in claim 36, wherein the music processing component is callable to receive groups music events and associated timestamps, the timestamps indicating varying times at which the respective music events are to be played.

40. A music generation system as recited in claim 36, wherein the music processing component comprises a kernel-mode component and a non-kernel-mode component, wherein the non-kernel-mode component is called by an application program to return said earliest time.

41. A music generation system as recited in claim 36, wherein:

the music processing component comprises a kernel-mode component and a non-kernel-mode component;

the non-kernel-mode component is callable to receive a group of music events to be played at varying times after said earliest time.

42. A music generation system as recited in claim 36, wherein:

the music processing component comprises a kernel-mode component and a non-kernel-mode component;

the non-kernel-mode component is called by an application program to return said earliest time;

the non-kernel-mode component is callable to receive a group of music events to be played at varying times after said earliest time;

wherein the non-kernel mode component passes the group of music events to the kernel-mode component.

43. A music generation system as recited in claim 36, wherein the music processing component comprises a software-based synthesizer.

44. A music generation system as recited in claim 36, wherein the music processing component comprises a hardware-based synthesizer.

45. A music generation system as recited in claim 36, wherein the music events comprise data structures specifying music notes.

46. A music generation system as recited in claim 36, further comprising a plurality of music processing components, wherein all of the music processing components use a common time base to interpret the timestamps of the music events.

47. A music generation system comprising:

a music processing component having a latency between the time at which it receives a music event and the earliest time at which the it can play the music event;

the music processing component having an interface that is callable to return the earliest time at which the music processing component can play a new music event;

an application program that initiates repeated calls to the music processing component and provides a group of music events to be sent to the music processing component during each call;

wherein said group of music events comprises a plurality of individual music events and associated timestamps indicating when the music events are to be played, wherein the timestamps of the individual music events of a particular group indicate that the individual music events are to be played at varying times subsequent to said earliest time at which the music processing component can play a new music event.

48. A music generation system as recited in claim 47, wherein the latency is variable with time.

49. A music generation system as recited in claim 47, wherein the music processing component comprises a kernel-mode component and a non-kernel-mode component, wherein the non-kernel-mode component is called by the application program to return said earliest time.

50. A music generation system as recited in claim 47, wherein:

the music processing component comprises a kernel-mode component and a non-kernel-mode component;

the non-kernel-mode component is callable to receive the group of music events.

51. A music generation system as recited in claim 47, wherein:

the music processing component comprises a kernel-mode component and a non-kernel-mode component;

the non-kernel-mode component is called by the application program to return said earliest time;

the non-kernel-mode component is called by the application program to receive the group of music events;

wherein the non-kernel mode component passes the group of music events to the kernel-mode component.

52. A music generation system as recited in claim 47, wherein the music processing component comprises:

a synthesizer driver;

a sequencer that receives the group of music events and that provides the individual music events to the synthesizer driver at the times indicated by the timestamps of the individual music events;

wherein the synthesizer driver plays the music events as they are received.

53. A music generation system as recited in claim 47, wherein the music processing component comprises a software-based synthesizer.

54. A music generation system as recited in claim 47, wherein the music processing component comprises a hardware-based synthesizer.

55. A music generation system as recited in claim 47, wherein the music events comprise data structures specifying music notes.

56. A computer program stored on one or more computer-readable storage media for playing music events, which, when executed by a host computing system, implement a method comprising:

calling a music processing component to determine the earliest time at which the music processing component can play new music events;

compiling a group of music events that are to be played after the earliest time at which the music processing component can play new music events;

time-stamping the music events of the compiled group with the times at which the music events are to be played by the music processing component; and sending the compiled group of music events and their timestamps to the music processing component as a group in a single call.

57. A computer program as recited in claim 56, wherein the recited steps are performed repeatedly to provide groups of music events and their timestamps to the music processing component early enough to be played by the music processing component at the times indicated by the timestamps of the music events.

58. A computer program as recited in claim 56, wherein:

the music processing component comprises a kernel-mode component and a non-kernel-mode component;

the application program calls the non-kernel-mode component obtain said earliest time;

the application program calls the non-kernel-mode component to send the group of music events;

the non-kernel-mode component passes the group of music events to the kernel-mode component.

59. A computer program as recited in claim 56, wherein the music processing component comprises a software-based synthesizer.

60. A computer program as recited in claim 56, wherein the music processing component comprises a hardware-based synthesizer.

61. A computer program as recited in claim 56, wherein the music events comprise data structures specifying music notes.

* * * * *

UNITED STATES PATENT AND TRADEMARK OFFICE

CERTIFICATE OF CORRECTION

PATENT NO. : 6,353,124 B1
DATED : March 5, 2002
INVENTOR(S) : Robert George Whittaker et al.

It is certified that error appears in the above-identified patent and that said Letters Patent is hereby corrected as shown below:

Title page,
Item [63], please replace "Continuation of application No. 08/592,399, filed as application No. PCT/AU94/00440 on Aug. 2, 1993, now Pat. No. 5,792,786" with -- Continuation of application No. 08/592,399, which is a 371 of No. PCT/AU94/00440, filed on Aug. 2, 1994, now Pat. No. 5,792,786 --

Signed and Sealed this

Ninth Day of July, 2002

*Attest:*

*Attesting Officer*

JAMES E. ROGAN
*Director of the United States Patent and Trademark Office*